US006474979B1

(12) United States Patent
Rippelmeyer

(10) Patent No.: US 6,474,979 B1
(45) Date of Patent: Nov. 5, 2002

(54) DEVICE AND METHOD FOR TRIGGERING A GAS FURNACE IGNITOR

(75) Inventor: Dennis M. Rippelmeyer, Waterloo, IL (US)

(73) Assignee: Emerson Electric Co., St. Louis, MO (US)

( * ) Notice: Subject to any disclaimer, the term of this patent is extended or adjusted under 35 U.S.C. 154(b) by 6 days.

(21) Appl. No.: 09/650,916

(22) Filed: Aug. 29, 2000

(51) Int. Cl.[7] ..... G05F 1/44

(52) U.S. Cl. ..... 431/67; 431/6; 431/18; 431/258; 323/235

(58) Field of Search ..... 431/18, 6, 28, 431/67, 258, 260, 261, 262; 323/235

(56) References Cited

U.S. PATENT DOCUMENTS

| | | | | |
|---|---|---|---|---|
| 3,381,226 | A | * | 4/1968 | Jones et al. |
| 3,486,042 | A | * | 12/1969 | Watrous |
| 3,777,188 | A | | 12/1973 | Mazur |
| 3,882,328 | A | | 5/1975 | Mazgy et al. |
| 4,004,214 | A | | 1/1977 | Evans |
| 4,157,481 | A | | 6/1979 | Walton |
| 4,158,150 | A | | 6/1979 | Dever |
| 4,188,181 | A | * | 2/1980 | Ripplemeyer |
| 4,390,795 | A | | 6/1983 | Tharrington |
| 4,402,664 | A | * | 9/1983 | Kutrieb |
| 4,435,150 | A | * | 3/1984 | Ripplemeyer |
| 4,492,878 | A | | 1/1985 | Hamel |
| 4,798,971 | A | | 1/1989 | Gravely |
| 4,925,386 | A | | 5/1990 | Donnelly et al. |
| 4,978,292 | A | * | 12/1990 | Donnelly et al. |
| 5,057,669 | A | | 10/1991 | Dennison |
| 5,323,062 | A | | 6/1994 | Crawford et al. |
| RE35,013 | E | | 8/1995 | Dennision |
| 5,470,223 | A | | 11/1995 | McCoy |
| 5,473,202 | A | | 12/1995 | Mudge et al. |
| 5,725,368 | A | | 3/1998 | Arensmeier |
| 5,865,612 | A | | 2/1999 | Hill et al. |
| 5,866,880 | A | | 2/1999 | Seitz et al. |
| 5,951,276 | A | | 9/1999 | Jaeschke et al. |
| 6,111,230 | A | * | 8/2000 | Cao et al. |

* cited by examiner

*Primary Examiner*—Carl D. Price
(74) *Attorney, Agent, or Firm*—Harness, Dickey & Pierce, P.L.C.

(57) ABSTRACT

An ignitor controller and method of providing the same triggers an ignitor switch of a gas appliance, such as a furnace, subsequent to the zero-crossing of the line voltage, but before the voltage exceeds +/−five volts. This effectively reduces EMI levels caused by the constant triggering of AC line voltage to the ignitor switch after +/−five volts, which constant triggering is needed to properly operate ignitors (e.g., silicon nitride ignitors) in electronic ignition systems. The controller includes a voltage detector circuit (i.e., a two transistor circuit), a series switch (i.e., a darlington array) and an energy storage device (i.e., a capacitor), which trigger the ignitor switch (e.g., a triac) sufficiently close to the line voltage zero-crossing to reduce line conducted interference.

19 Claims, 6 Drawing Sheets

DEVICE AND METHOD FOR TRIGGERING A GAS FURNACE IGNITOR

FIELD OF THE INVENTION

The present invention relates generally to controls for gas appliances, and more particularly to a drive circuit for triggering an ignitor of a gas furnace.

BACKGROUND OF THE INVENTION

Typical gas furnaces manufactured today include some type of electronic ignition system. The most common type incorporate hot surface ignitors which produce high temperatures (e.g., 2,000 degrees Fahrenheit) for burner ignition within the furnace. The ignitor, when activated, ignites gas flow at the main burner of the furnace without the use of a pilot light. These electric ignition systems increase the efficiency of the furnace, thereby increasing the efficiency of the HVAC system to which they are connected. Further, gas ignition is provided without the need for a continuously burning pilot light or flame.

However, with the extreme variations in temperature experienced by the hot surface ignitors, failure is more likely. New designs and material for use in these ignitors have been developed to extend the life of the ignitors and provide increased performance. For example, the Intell-Ignition™ integrated ignition system manufactured and sold by the White-Rodgers Division of Emerson Electric Co. includes a silicon nitride ignitor providing added strength and durability, thereby resulting in longer useful ignitor life. These ignitors also provide optimization of ignition temperature. Other types of hot surface ignitors may be constructed of various materials including aluminum nitride, silicon nitride, silicon carbide, boron carbide, tungsten disilicide, tungsten carbide, and mixtures thereof.

A problem with silicon nitride and similar ignitors is that in order to maintain proper operating temperature, the ignitor switch (e.g., a triac) must be constantly triggered (i.e., turned on and off) to control the current and voltage to the ignitor. Also, AC voltage is preferably provided to the ignitor in order to minimize material migration of ignitor elements, which migration may result from the ignitor brazing material (i.e., sliver) migrating from the positive ignitor electrode and negative ignitor electrode, thereby causing a short across the electrodes and failure of the ignitor. Thus, minimizing material migration extends the ignitor life. However, as a result of the constant triggering of the AC voltage, line conducted interference (i.e., electromagnetic interference (EMI)) results, particularly if the switch is triggered late in the line voltage cycle (i.e., +/−15 volts). This late triggering at too high a voltage causes a high ramp-up rate of the current through the switch to the ignitor with a corresponding current spike and accompanying EMI. This EMI not only can damage the component parts of an electronic ignition (e.g., a microcomputer or the ignitor), but also can result in other perceptible annoyances with surrounding systems, such as causing light flicker and interference with AM radio signals and RF controls. With the ignitor controllers and drive circuits presently available, triggering of ignitors occurs too late in the line voltage cycle (i.e., +/−15 volts), thereby resulting in excessive line conducted EMI. The known ignitor controllers for controlling ignitor ignition include triac drivers. However, these drivers fail to consistently trigger ignitor switches close enough to the zero-crossing of the line voltage to sufficiently reduce EMI. Line filters are also used to reduce EMI, however, such filters are costly.

SUMMARY OF THE INVENTION

The present invention provides an ignitor controller and method of providing the same for reducing EMI in gas appliances, and specifically gas furnaces using silicon nitride and similar ignitors. The EMI results from the constant switching of AC power to these types of ignitors that is required to maintain acceptable temperature levels for proper ignition and operation. Specifically, the invention provides a controller including a drive circuit configured to trigger an ignitor switch in order to reduce line-conducted interference. The controller of the present invention provides trigger pulses to the igniter switch (e.g., a triac) controlling an ignitor ignition, such that the triac is triggered after the zero-crossing of the line voltage to the triac, but before the line voltage increases to a point where excessive EMI results.

Succinctly, the present invention provides an ignitor controller having a zero-crossing triac drive circuit for triggering an ignitor of a gas furnace. The inventor has determined that in order to sufficiently reduce EMI levels, a triac controlling a silicon nitride ignitor is preferably triggered after the AC line voltage crosses a zero-voltage point, but prior to reaching +/−five volts.

A zero-crossing triac drive circuit constructed according the principles of the present invention essentially comprises a series switch, a two-transistor zero-voltage detector circuit, and an energy storage device to ensure triggering after the zero-crossing point. As part of an integrated control system for an HVAC unit, the series switch may be provided in series with an optocoupler connected to a microcomputer which can enable or inhibit the triac drive pulse from the series switch as required by the system. The optocoupler provides electrical isolation between the low voltage portion of the HVAC system (i.e., 24 volt thermostat control) and the high voltage portion (i.e., the system components requiring line voltage (e.g., 110 volts) to operate, such as the furnace). The series switch is turned "off" by the conduction of one transistor of the zero-voltage detector circuit during the positive phase of the AC line voltage and the other transistor of the zero-voltage detector circuit during the negative phase of the AC line voltage.

The ignitor controller of the present invention not only sufficiently minimizes EMI levels, but also reduces the cost of manufacture and operation, while requiring less physical space to implement and construct.

While the principal advantages and features of the present invention have been explained above, a more complete understanding of the invention may be attained by referring to the description of the preferred embodiments which follow.

DETAILED DESCRIPTION OF PREFERRED EMBODIMENTS

An ignitor controller constructed according to the principles of the present invention is shown and described in conjunction with gas appliances incorporating a modulated silicon nitride ignitor, for example in a furnace. Of course, the ignitor controller could also be provided in conjunction with other gas appliances, such as hot water heaters and gas stoves.

Figure 1:
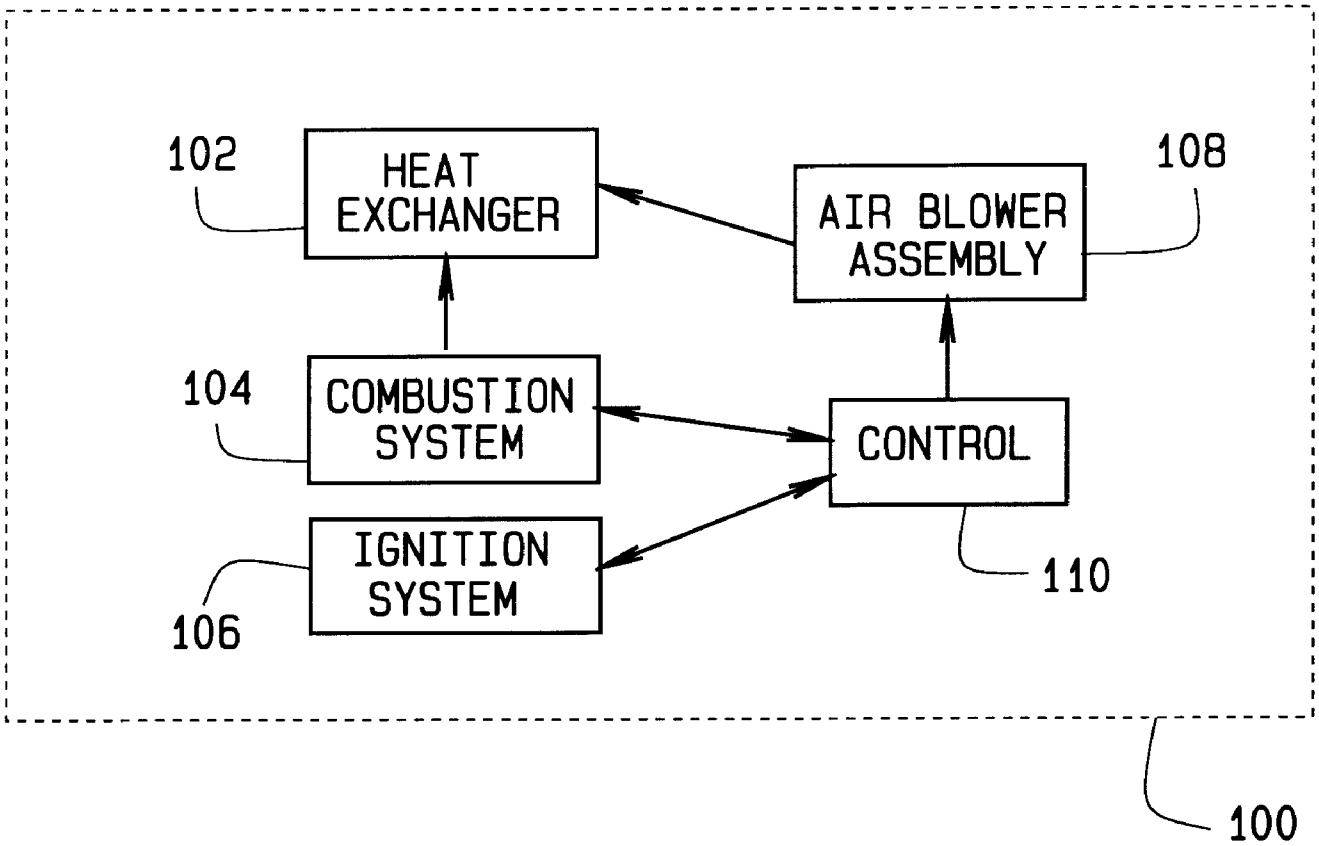
FIG. 1 is a block diagram showing the component parts of a typical furnace for use in connection with an HVAC system in which an ignitor controller constructed according to the principles of the present invention may be implemented.

As shown in FIG. 1, a typical gas furnace system 100 includes a heat exchanger 102, a combustion system 104, an ignition system 106, an air blower assembly 108 and an operator control 110 (e.g., a thermostat). The operator control 110, which is programmed or configured by a user, operates the various aspects of an HVAC system, which typically includes a furnace system 100. This operation includes, for example, activation of the heating of the gas furnace which requires the opening of a gas valve and triggering of an ignitor.

Figure 2:
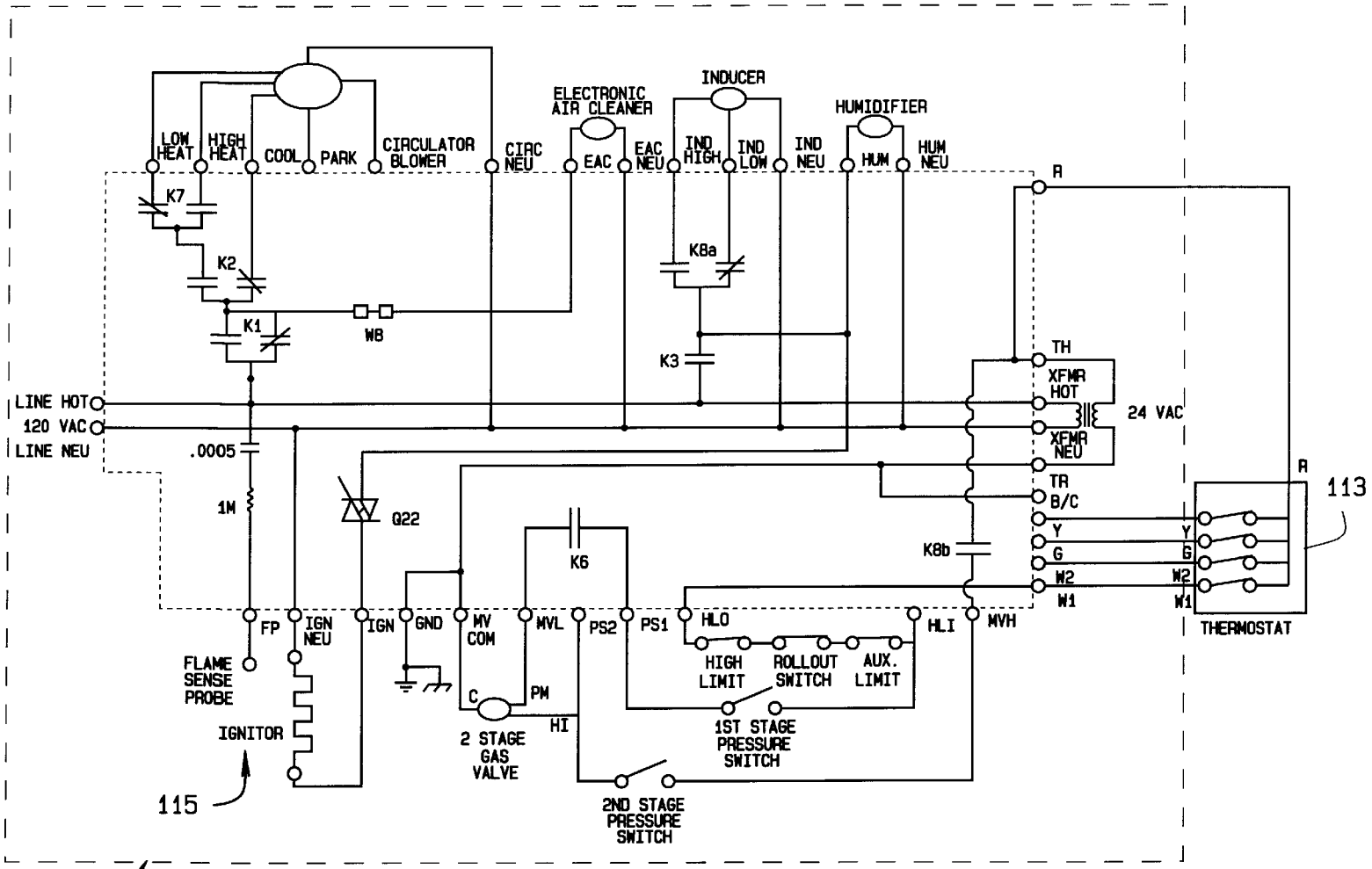
FIG. 2 PRIOR ART
FIG. 2 is a schematic diagram of a furnace control system in connection with which an ignitor controller constructed according to the principles of the present invention may be implemented.

More specifically, as shown in FIG. 2, an integrated furnace control 112 may be used in connection with the operator control 110, such as a thermostat 113, to control operation of a furnace. The ignitor controller 118 of the present invention can be provided as part of the furnace control shown in FIG. 2, which furnace control may be for example the 50A50 Integrated Furnace Control manufactured and sold by the White-Rodgers Division of Emerson Electric Co. The ignitor controller 118 of the present invention operates in conjunction with the furnace control 112, and specifically the ignitor 115, to provide reduced EMI emission. An integrated ignition system also may be provided as part of the furnace control 112, giving added control of the ignitor 115. The integrated ignition system may be the 50A65 Silicon Nitride Intell-Ignition™ system manufactured and sold by the White-Rodgers Division of Emerson Electric Co.

Figure 3:
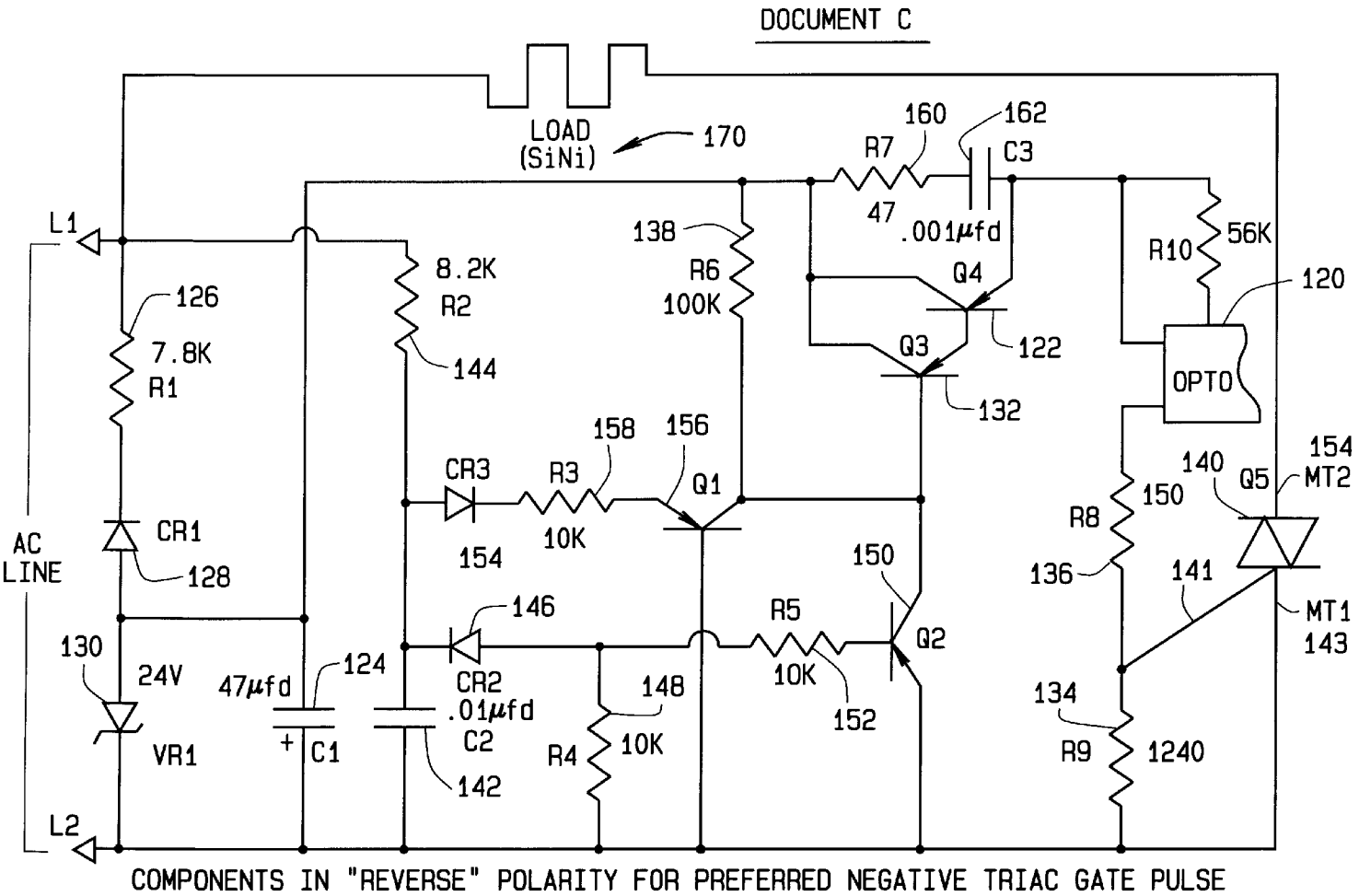
FIG. 3 is a schematic diagram of an ignitor controller constructed according to the principles of the present invention.

Generally, as shown in FIG. 3, an ignitor controller 118 constructed according to the principles of the present invention includes a circuit having a series switch or gate which allows a microcomputer to trigger an ignitor switch only when the AC line voltage has crossed and is very close to the zero-crossing point of the AC current. The ignitor switch, which may control for example a silicon nitride ignitor, is preferably triggered after the zero-crossing point, but before the AC line voltage reaches +/−five volts. This triggering or operation of the ignitor switch only in the vicinity of the zero-crossing point greatly reduces the line-conducted interference in the system caused if the line voltage is too high when the ignitor switch is triggered.

Specifically, the ignitor controller 118 of the present invention provides a zero-crossing drive circuit for triggering an ignitor switch, which is preferably a triac, and includes an energy storage device (e.g., a capacitor), a series switch (i.e., a darlington transistor or array) and a two-transistor zero voltage detector circuit, along with other components to provide proper operating levels and timing. Also, the series switch may be provided in series with an optocoupler connected to a microcomputer which enables or inhibits triac drive pulses from the darlington series switch. As described herein, this provides added safety by electrically isolating the low voltage components and the high voltage components in an HVAC system. This also provides ease in integration, as optoisolator and microcontroller circuits are common to hot surface ignition (HSI) controls, including the 50M61 HSI control manufactured and sold by the White-Rodgers Division of Emerson Electric Co. The ignitor controller 118 of the present invention reduces line EMI by combining these components to trigger an ignitor within +/−five volts of the zero-crossing of the line voltage. The combination is implemented in a surprisingly compact design such that, if desired, the ignitor controller may be easily integrated into an existing furnace control.

With respect to the general operation of the ignitor controller of the present invention, the series darlington switch is "turned off" by the conduction of one line-sensing transistor of the two-transistor zero voltage detector during the positive phase of the AC current and by the conduction of the other line-sensing transistor during the negative phase of the AC current. Thus, the darlington switch is "off" such that the ignitor switch is prevented from triggering when the AC line voltage is too high (i.e., exceeds +/−five volts). The series switch conducts (i.e., is "turned on") only when both line-sensing transistors are "turned off," which occurs very close to the AC line current zero-crossing. With the series switch conducting, the ignitor switch may be triggered. Further, a capacitor provides proper delay to the two-line sensing transistors to ensure switch action after the zero-crossing of the AC line current and not before. It should be noted that when reference is made to a switch (e.g., a transistor) being "turned on," that switch is forward biased or conducting, and when reference is made to a switch that is "turned off," that switch is reverse biased or not conducting.

Preferably, when the series darlington switch is "turned on," it provides current to the triac gate sourced from preferably an electrolytic storage capacitor. Thereafter, the optoisolator controlled by the ignition controls' computer determines whether to activate or "fire" the triac by inhibiting or enabling current flow through the darlington switch.

Figure 5:
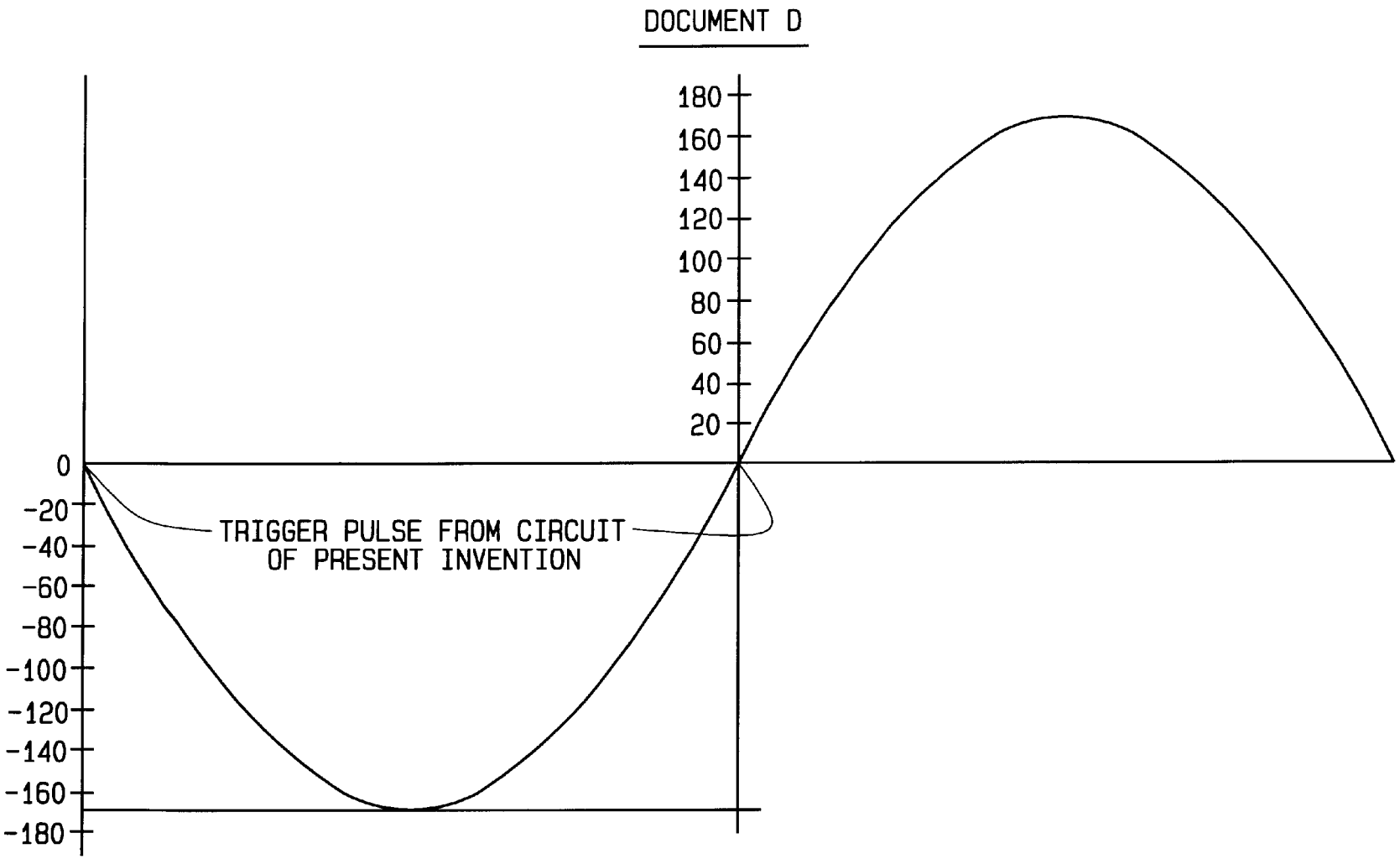
FIG. 5 is a graph of the line voltage curve illustrating trigger pulses to an ignitor controlled by an ignitor controller constructed according to the principles of the present invention.

As shown in FIG. 5, the ignitor controller 118 of the present invention supplies a trigger pulse capable of activating or "firing" a triac in quadrants two and three of the AC line voltage after and sufficiently close to the zero crossing of the power line (i.e., +/−five volts), thus resulting in reduced line conducted EMI. This interference is caused by "firing" of the triac too late (i.e., at too high a voltage) in the line cycle. Quadrant two occurs during the period of time in which the triac main terminal (MT2) 145 voltage is positive and the triac gate 141 voltage is negative. Quadrant three occurs during the period of time in which the MT2 145 voltage is negative and the triac gate 141 voltage is also negative. As described herein, due to the constant switching required to operate a typical silicon nitride ignitor and maintain proper ignitor temperature, triggering of the ignitor close to the zero-crossing of the line voltage reduces EMI by reducing the current ramp-up rate (di/dt) and corresponding current spike.

Referring again to FIG. 3, activation or triggering of the triac 140 is generally provided by the output of the optoisolator 120, which is in series with transistor (Q4) 122. With respect to the triggering of the triac 140, the triac gate 141 is "on" and provides for current flow through the gate when Q4 122 is "on." It should be noted that the triggering of the triac 140 is preferably provided by a negative pulse.

With respect to triggering the triac 140 after the zero-crossing, because no power is available from the power line during the zero-crossing, the ignitor controller 118 preferably stores energy for use during this period. Specifically, capacitor (C1) 124, which is preferably an electrolytic capacitor, is charged using resistor (R1) 126 and diode (CR1) 128 when the AC line voltage (L1) is negative. Zener diode (VR1) 130 provides a clamp and limits the voltage of C1 124 to preferably approximately twenty-four volts.

During the zero-crossing of the line voltage, current flows from C1 124 through the emitter-base junctions of Q4 122 and transistor (Q3) 132 (forming the darlington transistor or array) using resistor (R9) 134, resistor (R8) 136 and resistor (R6) 138, thereby saturating Q4 122. With Q4 122 saturated or conducting, current through the triac gate 141 flows from C1 124 to the MT1 power terminal 143 of the triac 140, through R8 136, the emitter-collector junction of Q4 122 and back to C1 124.

As L1 goes negative, a phase shift capacitor (C2) 142 is preferably provided and is charged using resistor (R2) 144. C2 142 thereafter charges sufficiently to forward bias diode (CR2) 146 which provides current flow through resistor (R4) 148. The current flow through R4 148 increases until the voltage drop across R4 148 is sufficient to forward bias the base-emitter junction of transistor (Q2) 150 using resistor (R5) 152. Thus, Q2 150 will turn "on" (i.e., current will flow through the emitter-collector junction). Essentially, this redirects the emitter-base junction current flow of Q3 132 and Q4 122 through the emitter-collector circuit of Q2 150, thereby turning "off" Q3 132 and Q4 122. This process will reverse as the negative L1 returns to zero.

When L1 goes positive, C2 142 charges in the opposite direction using R2 144. When C2 142 charges sufficiently to forward bias the combined junctions of diode (CR3) 154 and the emitter-base junction of transistor (Q1) 156, current flows through resistor (R3) 158, thereby turning "on" the emitter-collector junction of Q1 156. This redirects the current from the emitter-base junctions of Q3 132 and Q4 122 through the emitter-collector circuit of Q1 156, thereby turning "off" Q3 132 and Q4 122. This process will reverse as the positive L1 returns to zero.

Thus, current flow to the silicon nitride ignitor 170 occurs only after the zero-crossing of the line voltage, which is provided in part by C1 124 (ensuring proper delay to the two line sensing transistors Q1 156 and Q2 150), but before the line voltage exceeds +/−five volts, which occurs only when the darlington switch (Q3 132 and Q4 122) is turned "on," thereby supplying current to the triac gate 141 (i.e., triggering the triac 140). The darlington switch is allowed to conduct (i.e., is turned "on") only when both line-sensing transistors (Q1 156 and Q2 150) are turned "off," which only occurs very close to the zero-crossing of the line voltage. Q1 156 controls triggering of the triac 140 using the darlington switch or array (Q3 132 and Q4 122) during the positive cycle of the line-voltage, and Q2 150 controls the triggering during the negative cycle. Essentially, Q1 156 "turns on" during the positive cycle of the line AC, thereby "turning off" the darlington switch, and Q2 150 "turns on" during the negative cycle of the line AC, thereby "turning off" the darlington switch. Thus, these transistors (Q1 156 and Q2 150) prevent triggering of the triac 140 after the line voltage exceeds +/−five volts, thereby reducing EMI.

It should be noted that resistor (R7) 160 and capacitor (C3) 162 stabilize the darlington transistor or array comprising Q3 132 and Q4 122 to prevent oscillation. Further, as should be appreciated by one skilled in the art, R2 144 and C2 142 are sized to prevent Q1 156 and Q2 150 from turning "off" before the zero-crossing of the line voltage. However, as the two circuits provided in connection with these transistors (Q1 156 and Q2 150) are not symmetrical (common emitter and common base), when R2 144 and C2 142 are sized to turn "off" Q1 156 at zero, Q2 150 will turn "off" too late without R4 148. Therefore, as shown in FIG. 3, R4 148 is sized to reduce the delayed turn "off" of Q2 150.

Figure 4:
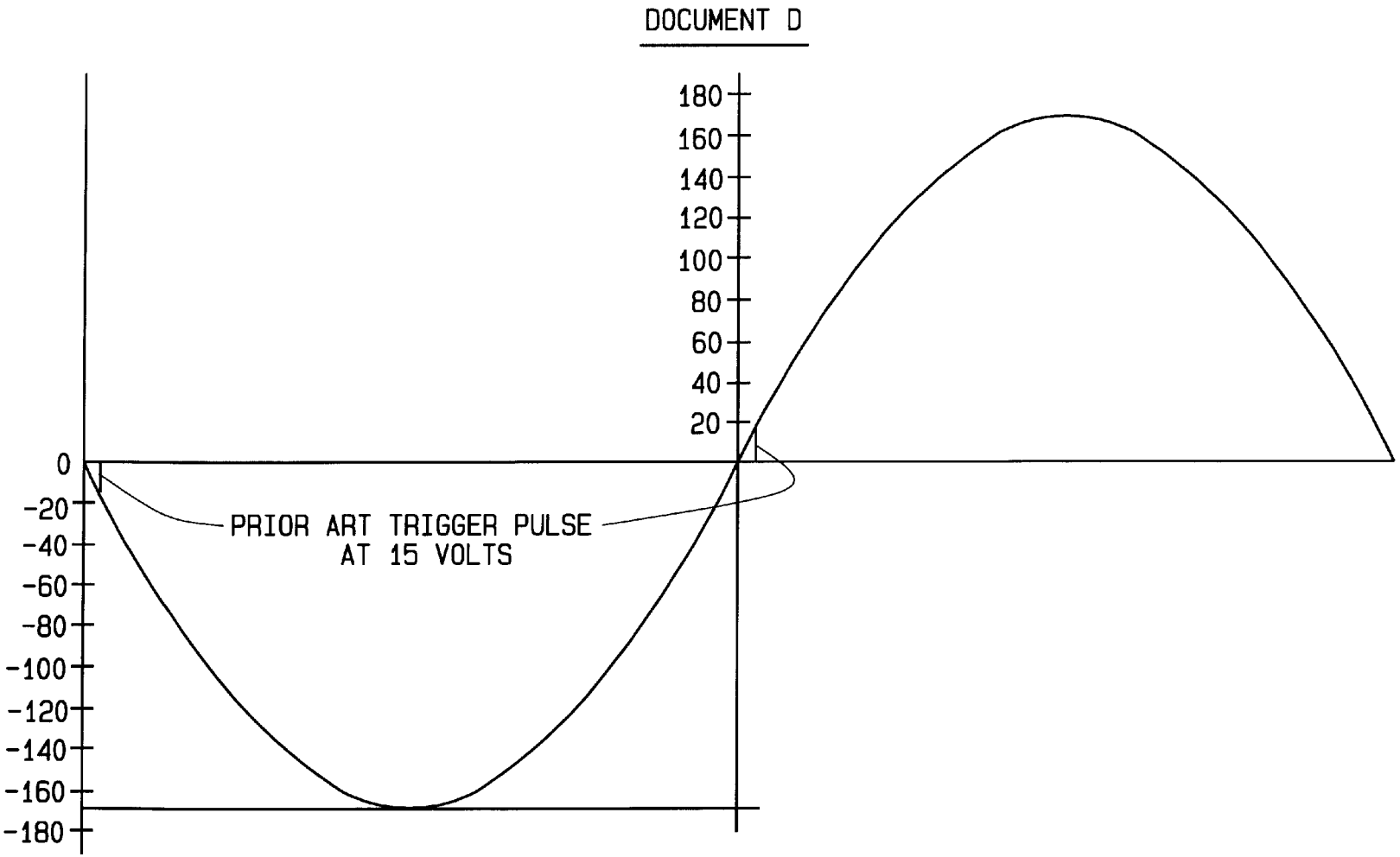
FIG. 4 is a graph of the line voltage curve illustrating trigger pulses to an ignitor controlled by a prior art ignitor system.

Thus, as shown in FIG. 5, the ignitor controller 118 of the present invention provides for ignitor ignition subsequent to the zero-crossing of the line voltage, but prior to the line voltage exceeding +/−five volts. Prior to the invention described herein, and as shown in FIG. 4, ignitor ignition typically occurred at +/−fifteen volts, thereby resulting in unacceptable line conducted interference.

Figure 6:
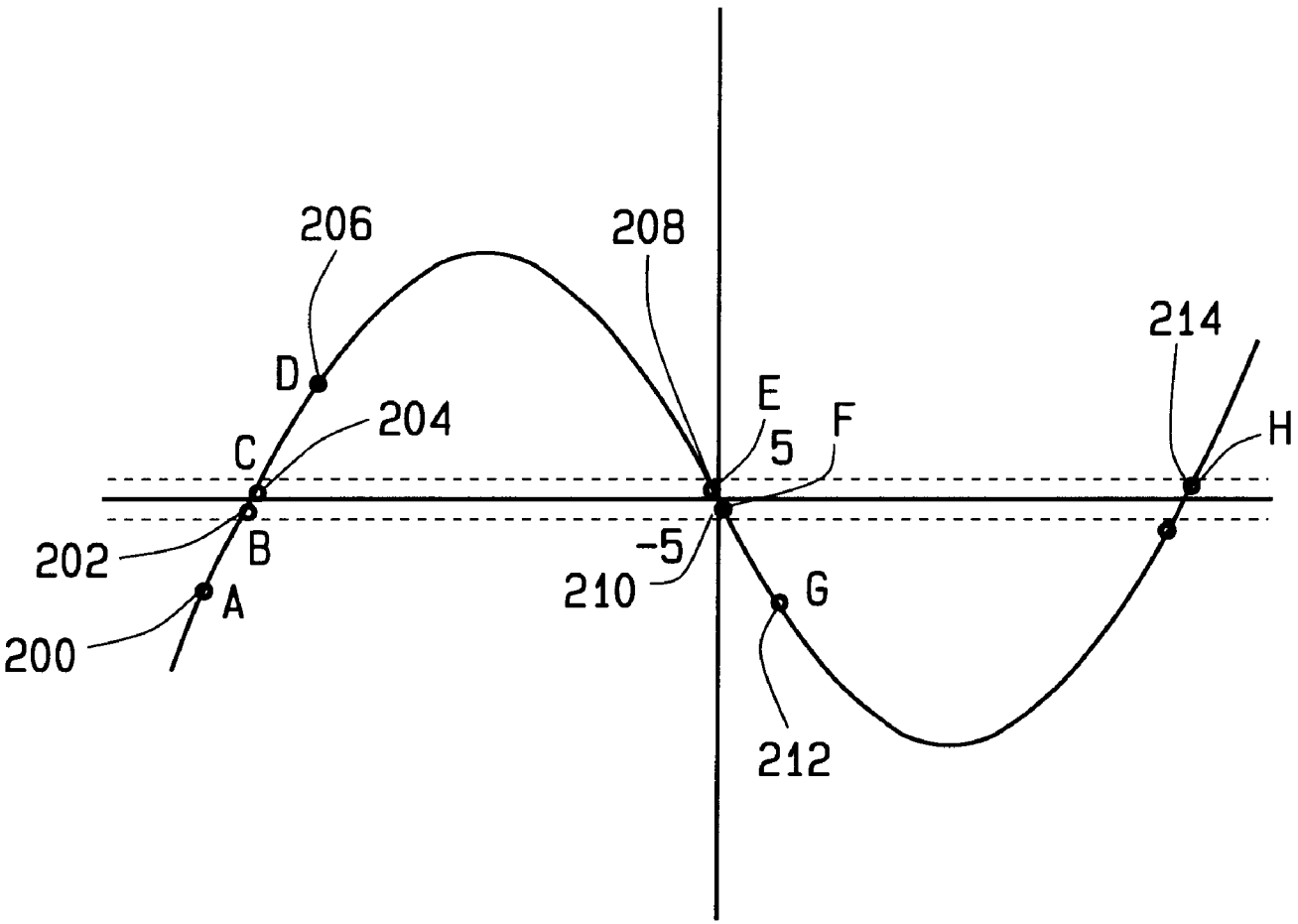
FIG. 6 is a graph illustrating different operating points of an ignitor controlled by an ignitor controller constructed according to the principles of the present invention.

In operation, as shown in FIG. 6, as the AC voltage increases from point A at 200 to point B at 202, Q2 150 is "on," thereby turning the darlington array (Q3 132 and Q4 122) "off." As the voltage of the AC line current crosses zero, Q2 150 "turns off" and with Q1 156 already "off," the darlington array "turns on" at point C 204, thereby allowing the triggering of the triac 140. As the line voltage increases, Q1 156 "turns on," thereby "turning off" the darlington array "off." This prevents the triggering of the triac 140 at for example point D 206. As the voltage again approaches zero, Q1 156 remains "on" at point E 208. At point F 210, Q1 is "turned off" and with Q2 150 already "off," the darlington array "turns on" allowing the triggering of the triac 140. Again, at point G 212, Q2 150 is "on," thereby "turning off" the darlington array. At point H 214, the voltage of the line AC current has again crossed zero and both Q1 156 and Q2 150 are "off," thereby "turning on" the darlington array and allowing the triggering of the triac 140.

It should be noted that C2 142 provides phase shifting to ensure that the triac 140 fires after the zero-crossing of the AC line voltage. Thus, the darlington array is "turned off," until after the zero-crossing. R2 144, R3 158, R4 148 and C2 142 are sized to ensure that the darlington array in "turned on" before the line voltage exceeds +/−five volts (i.e., Q1 156 and Q2 150 are both "off" after the zero-crossing of the line AC, but prior to the voltage exceeding +/−five volts).

With respect to the values of the component parts (e.g., resistors and capacitors) as indicated in FIG. 3 and listed below, it should be noted that these values may be adjusted as required or desired depending upon the particular application.

| | |
|---|---|
| R1 | 7.8K |
| R2 | 8.2K |
| R3 | 10K |
| R4 | 10K |
| R5 | 10K |
| R6 | 100K |
| R7 | 47 |
| R8 | 150 |
| R9 | 1240 |
| R10 | 56K |
| C1 | 47 μfd |
| C2 | .01 μfd |
| C3 | .001 μfd |

The following component parts are also provided as indicated in FIG. 3, but may be changed or substituted:

| Part | Manufacturer |
|---|---|
| Triac (MAC8) | Motorola |
| Transistors (MMBTA55) | ON Semiconductor |
| Optoisolator (4N32) | QT Optoelectronics |
| Diodes (1N4004) | General Instruments |

It should also be noted that when reference is made to turning "on" a component part of the invention, this refers to providing forward current flow through or forward biasing a component part, which includes the conduction of that component part. Turning "off" a component part refers to blocking current flow through or reverse biasing a component part, which includes that component part not conducting.

There are other various changes and modifications which may be made to the particular embodiments of the invention described herein, as recognized by those skilled in the art. However, such changes and modifications of the invention may be constructed without departing from the scope of the invention. Thus, the invention should be limited only by the scope of the claims appended hereto, and their equivalents.

What is claimed is:

1. A controller for controlling activation of an ignitor of a gas appliance, the controller comprising:

an ignitor switch configured to selectively connect an ignitor to a line voltage to power the ignitor;

a series switch configured to trigger the operation of the ignitor switch;

a zero voltage detector circuit including two line-sensing transistors and a phase shifting circuit configured to delay the operation of the two line-sensing transistors, the zero voltage detector circuit configured to prevent the series switch from triggering the operation of the ignitor switch until after a zero crossing of the applied line voltage, and to trigger the ignitor switch before the magnitude of the applied line voltage exceeds about five volts; and the zero voltage detector circuit also including a delay reducing circuit configured to reduce the delay of the operation of one of the two line-sensing transistors.

2. The controller according to claim 1 wherein the ignitor switch is a triac.

3. The controller according to claim 1 further comprising an energy storage device connected to the series switch and providing energy to trigger the operation of the ignitor switch subsequent to a zero crossing of the line voltage.

4. The controller according to claim 1 wherein the series switch further comprises two transistors controlling switching of the ignitor switch.

5. The controller according to claim 4 wherein the series switch is a darlington array.

6. The controller according to claim 5 wherein the gas appliance is a furnace having high voltage component parts, and further comprising an optoisolator connected to the series switch for electrically isolating the controller from the high voltage component parts of the gas furnace.

7. The controller according to claim 1 wherein the two line-sensing transistors shunt current from the series switch to prevent triggering of the zero voltage detector circuit.

8. The controller according to claim 7 wherein one of the line-sensing transistors is configured to operate during the positive cycle of line voltage, and the other line-sensing transistor is configured to operate during the negative cycle of line voltage.

9. The controller according to claim 8 wherein the two line-sensing transistors are configured to trigger the series switch only when both transistors are off.

10. The controller according to claim 9 wherein the series switch is configured to trigger the ignitor switch with a negative pulse.

11. The controller according to claim 1 wherein the ignitor is a silicon nitride ignitor.

12. In combination with an ignitor for use in a gas appliance, a controller for activating the ignitor, the controller comprising an ignitor switch configured to selectively connect an ignitor to AC line voltage to power the ignitor; a series switch configured to trigger the operation of the ignitor switch; a zero voltage detector circuit including two line-sensing transistors and a phase shifting circuit configured to delay the operation of the two line-sensing transistors, the zero voltage detector circuit configured to prevent the series switch from triggering the operation of the ignitor switch until after a zero crossing of the applied line voltage, and to trigger the ignitor switch before the magnitude of the applied line voltage exceeds about five volts; and the zero voltage detector circuit also including a delay reducing circuit configured to reduce the delay of the operation of one of the two line-sensing transistors.

13. A controller integrated with a gas furnace having an ignitor, the controller providing activation of the ignitor and comprising:

an ignitor switch configured to selectively connect an ignitor to a line voltage to power the ignitor;

a series switch configured to trigger the operation of the ignitor switch;

a zero voltage detector circuit including two line-sensing transistors and a phase shifting circuit configured to delay the operation of the two line-sensing transistors, the zero voltage detector circuit configured to prevent the series switch from triggering the operation of the ignitor switch until after a zero crossing of the applied line voltage, and to trigger the ignitor switch before the magnitude of the applied line voltage exceeds about five volts; and the zero voltage detector circuit also including a delay reducing circuit configured to reduce the delay of the operation of one of the two line-sensing transistors.

14. A controller having an improved drive circuit for controlling an ignitor switch configured to selectively connect AC line voltage to activate an ignitor of a gas furnace, the improved drive circuit comprising a series switch configured to trigger the operation of the ignitor switch;

a zero voltage detector circuit including two line-sensing transistors and a phase shifting circuit configured to delay the operation of the two line-sensing transistors, the zero voltage detector circuit configured to prevent the series switch from triggering the operation of the ignitor switch until after a zero crossing of the applied line voltage, and to trigger the ignitor switch before the magnitude of the applied line voltage exceeds about five volts; and the zero voltage detector circuit also including a delay reducing circuit configured to reduce the delay of the operation of one of the two line-sensing transistors.

15. A method of controlling the triggering of an ignitor switch of a gas appliance, the ignitor switch selectively connecting the ignitor to line voltage to power the ignitor, the method comprising utilizing a zero voltage detector circuit comprising two line-sensing transistors to detect zero crossing points of the line voltage, delaying the operation of the two line-sensing transistors utilizing a phase-shift circuit; and reducing the delay of one of the two line-sensing transistors utilizing a delay-reducing circuit, so that the ignitor switch is triggered only after a zero crossing of the line voltage and when the line voltage is between about negative five volts and about positive five volts.

16. The method according to claim 15 further comprising storing energy in a storage member, and using the stored energy to trigger the ignitor only after the zero crossing points of the line voltage.

17. A controller for controlling the ignitor of a gas appliance, the controller comprising:

an ignitor switch configured to selectively connect an ignitor to AC line voltage to power the ignitor;

a series switch configured to trigger the operation of the ignitor switch;

a zero voltage detector circuit including two line-sensing transistors and a phase shifting circuit configured to delay the operation of the two line-sensing transistors, the zero voltage detector circuit configured to prevent the series switch from triggering the operation of the ignitor switch until after a zero crossing of the applied line voltage, and to trigger the ignitor switch before the magnitude of the applied line voltage exceeds about five volts; and the zero voltage detector circuit also including a delay reducing circuit configured to reduce the delay of the operation of one of the two line-sensing transistors.

18. A controller for controlling the ignitor of a gas appliance, the controller comprising:

an ignitor switch configured to selectively connect an ignitor to AC line voltage to power the ignitor;

a series switch configured to trigger the operation of the ignitor switch;

a zero voltage detector circuit including two line-sensing transistors and a phase shifting circuit configured to delay the operation of the two line-sensing transistors, the zero voltage detector circuit configured to operate the series switch to trigger the operation of the ignitor switch only after the line voltage crosses zero to about positive five volts and after the line voltage crosses zero to about negative five volts; and the zero voltage detector circuit also including a delay reducing circuit configured to reduce the delay of the operation of one of the two line-sensing transistors.

19. The controller according to claim 18 wherein the gas appliance is a furnace that includes a silicon nitride ignitor, and wherein the ignitor switch is configured to provide line voltage to the ignitor to maintain the temperature of the ignitor below a maximum level.

* * * * *